US007392649B2

(12) United States Patent
Wassenhoven

(10) Patent No.: US 7,392,649 B2
(45) Date of Patent: Jul. 1, 2008

(54) FEEDING TROUGH FOR A SLIVER OPENING DEVICE OF AN OPEN-END SPINNING DEVICE

(75) Inventor: Heinz-Georg Wassenhoven, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 211 days.

(21) Appl. No.: 10/575,497

(22) PCT Filed: Sep. 3, 2004

(86) PCT No.: PCT/EP2004/009888

§ 371 (c)(1),
(2), (4) Date: Apr. 10, 2006

(87) PCT Pub. No.: WO2005/047578

PCT Pub. Date: May 26, 2005

(65) Prior Publication Data

US 2007/0137168 A1 Jun. 21, 2007

(30) Foreign Application Priority Data

Oct. 16, 2003 (DE) ..... 103 51 365

(51) Int. Cl.
*D01H 4/08* (2006.01)

(52) U.S. Cl. ..... 57/408

(58) Field of Classification Search ..... 57/408, 57/412–414

See application file for complete search history.

(56) References Cited

U.S. PATENT DOCUMENTS

| | | | | |
|---|---|---|---|---|
| 3,950,929 A | | 4/1976 | Morikawa et al. | 57/58.95 |
| 4,387,558 A | * | 6/1983 | Rehm et al. | 57/408 |
| 4,926,627 A | | 5/1990 | Braun et al. | 57/412 |
| 5,673,548 A | * | 10/1997 | Raasch et al. | 57/412 |
| 5,832,710 A | * | 11/1998 | Geerlings | 57/301 |

(Continued)

FOREIGN PATENT DOCUMENTS

DE 3501842 A1 7/1986

(Continued)

*Primary Examiner*—Shaun R Hurley
(74) *Attorney, Agent, or Firm*—Kennedy Covington Lobdell & Hickman, LLP

(57) ABSTRACT

A feeding trough for a sliver opening device of an open-end spinning device, having a concave gripping area for conveying a sliver, lateral walls for guiding the sliver, and a concavely curved support surface for fixing a fiber tuft combed by an opening roller, wherein the feeding trough is pivotable around a shaft parallel to the axis of the opening roller. The feeding trough (8) is arranged in its working position with a gap width A of 0.7 to 1.5 mm between the support surface (13) and adjoining tips (20) of the opening roller set (3) at a combing-in point K, which is constantly reduced to a gap width B of ≦0.5 mm over an angle area W in the direction of rotation of the opening roller (2) of at least 30°. The gap width opposite the direction of rotation of the opening roller (2) up to a transition area (14) between the support surface (13) and the gripping area (11) substantially increases by only an amount such that, when pivoting the feeding trough (8) opposite the direction of rotation of the opening roller (2), a contact with the tips of the teeth (20) is avoided.

7 Claims, 4 Drawing Sheets

U.S. PATENT DOCUMENTS

| | | | | |
|---|---|---|---|---|
| 5,870,890 | A * | 2/1999 | Baechler | 57/412 |
| 6,820,407 | B2 * | 11/2004 | Feuerlohn et al. | 57/400 |
| 2005/0076633 | A1 * | 4/2005 | Hirsch | 57/408 |

FOREIGN PATENT DOCUMENTS

| | | | |
|---|---|---|---|
| DE | 3817346 | A1 | 11/1989 |
| DE | 10206059 | A1 | 8/2003 |

* cited by examiner

FEEDING TROUGH FOR A SLIVER OPENING DEVICE OF AN OPEN-END SPINNING DEVICE

CROSS-REFERENCES TO RELATED APPLICATIONS

This application claims the benefit of German patent application 10351365.5, filed Oct. 16, 2003, herein incorporated by reference.

BACKGROUND OF THE INVENTION

The invention relates to a feeding trough for a sliver opening device of an open-end spinning device.

Sliver opening devices for open-end spinning devices are known in various embodiments and have been extensively explained in numerous patent publications.

For example, German Patent Publication DE 35 01 842 C2 describes a sliver opening device wherein a cylindrical, preferably corrugated sliver draw-in cylinder with an associated feeding trough constitutes a gripping area for the feed sliver.

The slowly rotating sliver draw-in cylinder here feeds the feed sliver to a downstream-located opening roller at a constant transport speed.

This means that on its way to the opening roller the feed sliver, which is preferably stored in sliver cans, first passes through a condenser, which not only condenses the feed sliver, but also provides it with a definite, suitable profile for draw-in.

The condensed feed sliver subsequently enters the gripping area constituted by the sliver draw-in cylinder and the feeding trough, which customarily is wider than the feed sliver. It is assured in this way that the feed sliver is also dependably gripped in the edge areas.

To prevent the feed sliver from spreading out too far and to get into the edge areas of the opening roller where, because of the termination of the saw-tooth card set, dependable combing of the feed sliver is no longer assured, a fiber tuft support with lateral strips is arranged following the gripping area.

The lateral strips also prevent uncontrolled lateral excursions of the feed sliver because of the helically-shaped arrangement of the saw tooth card set.

However, there is a relatively large nip between the gripping area and the fiber tuft support in the feeding trough in accordance with German Patent Publication DE 35 01 842 C2.

Furthermore, sliver opening devices for open-end spinning devices, which have an additional pressure roller in the area of the feeding trough, are known from German Patent Publication DE 38 17 346 C2, for example.

This means that this known feeding trough has a gripping area constituted by a special pressure roller and a sliver draw-in cylinder, which is followed via an extensively rounded transition area by a concavely curved support surface for the fiber tuft.

Furthermore, lateral guide surfaces for the feed sliver are arranged in the transition area.

With this known feeding trough a relatively large, free nip exists between the gripping area and the fiber tuft support. Added to this is that, because of the convex curvature of the two transport rollers, only one nip line results, which is arranged clearly distanced from the opening roller because of the roller arrangement alone.

The above described feeding troughs have quite proven themselves when producing standard yarn, however, they show considerable disadvantages if so-called novelty yarns are to be produced.

Such novelty yarns have, for example, defined thickened places at recurring distances.

It is necessary for producing such a novelty yarn to periodically change the amount of individual fibers to be fed into the spinning rotor, this means that the sliver to be fed to the opening roller must be repeatedly accelerated and slowed down over short periods of time.

With known feeding troughs the problem exists in this connection, that the feed sliver backs up in the above explained open nip during the acceleration period, and is therefore combed-out only insufficiently, or in a delayed manner. Because of this, the desired effects are more or less blurred, which interferes greatly with the fabric.

SUMMARY OF THE INVENTION

Starting from the above mentioned prior art, the object of the invention is based on creating a feeding trough which assures, in particular in connection with the production of novelty yarns, that the feed sliver is optimally combed out, also in the acceleration phase.

In accordance with the invention, this object is attained by a feeding trough wherein the feeding trough is embodied and arranged in its working position in such a way that a gap width A between the support surface and adjoining tips of the opening roller set at a combing-in point K amounts to 0.7 to 1.5 mm, which is constantly reduced over an angle area W in the direction of rotation of the opening roller of at least 30° to a gap width B of $\leqq 0.5$ mm, and that the gap width opposite the direction of rotation of the opening roller up to a transition area between the support surface and the gripping area substantially increases by only such an amount that, when pivoting the feeding trough opposite the direction of rotation of the opening roller around the pivot shaft, a contact with the tips of the teeth is avoided.

Advantageous embodiments of the invention are described below.

The invention proceeds from the recognition that in case of a high rotating speed of the teeth of the opening roller set a ventilating effect is created by the circulating airflow, which hampers the penetration of the fiber tuft into the opening roller set. This effect is a hindrance in particular if suddenly an increased amount of fibers is offered to the opening roller, such as is the case at the start of ornamentation in the yarn. The solution in accordance with the invention assures the forced entry of the fiber tuft first into the ventilation flow, which already favors the disentanglement of the fibers from the fiber tuft, as well as the rapid and complete gripping of the offered large amount of fibers by the opening roller set. On the one hand, the transition area to the support surface brought as closely as possible to the opening roller sees to this, but also in particular the continuous gap reduction between the support surface and the tips of the opening roller set. A pile-up of the fiber tuft which, inter alia, could result if the minimal gap width were to exist at the initial combing point, is also countered in this way. This negative effect is increased if, as in the prior art, sufficient free space for the fibers to give way is available upstream of this narrow gap.

The feed sliver, which is dependably conducted by the feeding trough in accordance with the invention directly to the tips of the opening roller set, cannot escape on any side, even in the acceleration phases. This means that when the sliver draw-in cylinder is briefly abruptly accelerated, and because of this feeds considerably more feed sliver to the opening roller, it is assured by means of the feeding trough in accordance with the invention that this definitely larger amount of feed sliver is also changed by the opening roller into a definitely larger amount of individual fibers.

This definitely larger amount of individual fibers is thereafter visible on the yarn as a clean ornamental effect.

Advantageous embodiments relate to the area of the feeding trough upstream of the combing-in point K. In the transition area, the feeding trough may have a convex curvature of a radius r≦2.0 mm, with lateral guide shoulders for the feed sliver being arranged in the convexly rounded transition area. The lateral guide shoulders may extend exclusively over the transition area. The gap width in the transition area may assume the distance C≦4 mm.

It should be pointed out here that the combing-in process is in no way limited to the combing-in point described in this way here, but instead already starts earlier and is carried out continuously over the entire range of the support surface. This combing-in point K only marks a location at which intensive combing-in starts by means of a continuous tapering of the gap.

The area located upstream of the combing-in point K assures that the feed sliver is supplied very rapidly, forced and completely, while avoiding detours between the gripping area and the opening roller, even in its acceleration phases. The restriction of the lateral guidance of the sliver to the transition area assures that the sliver, guided between the guide shoulders, is forced as closely as possible to the opening roller set already at this location.

The radius constituted by the tips of the opening roller set corresponds to the radius of curvature of the support surface from the combing-in point K over the angle area W, and that, for achieving the change of the gap width from A to B, the center M1 for the curvature of the support surface is correspondingly offset in respect to the center M of rotation of the opening roller. Such embodiment of the gap width course has shown itself to be particularly advantageous in regard to the effectiveness of the combing-out process, in particular under the conditions of the increased fiber feed-in.

The feeding trough may be embodied in one piece and provided with a wear-protective layer in its fiber-conducting areas. Such embodiment assures a long service life of the feeding troughs.

BRIEF DESCRIPTION OF THE DRAWINGS

The invention will be explained in greater detail in what follows by means of an exemplary embodiment represented in the drawings.

Shown are in.

DESCRIPTION OF THE PREFERRED EMBODIMENTS

Figure 1:
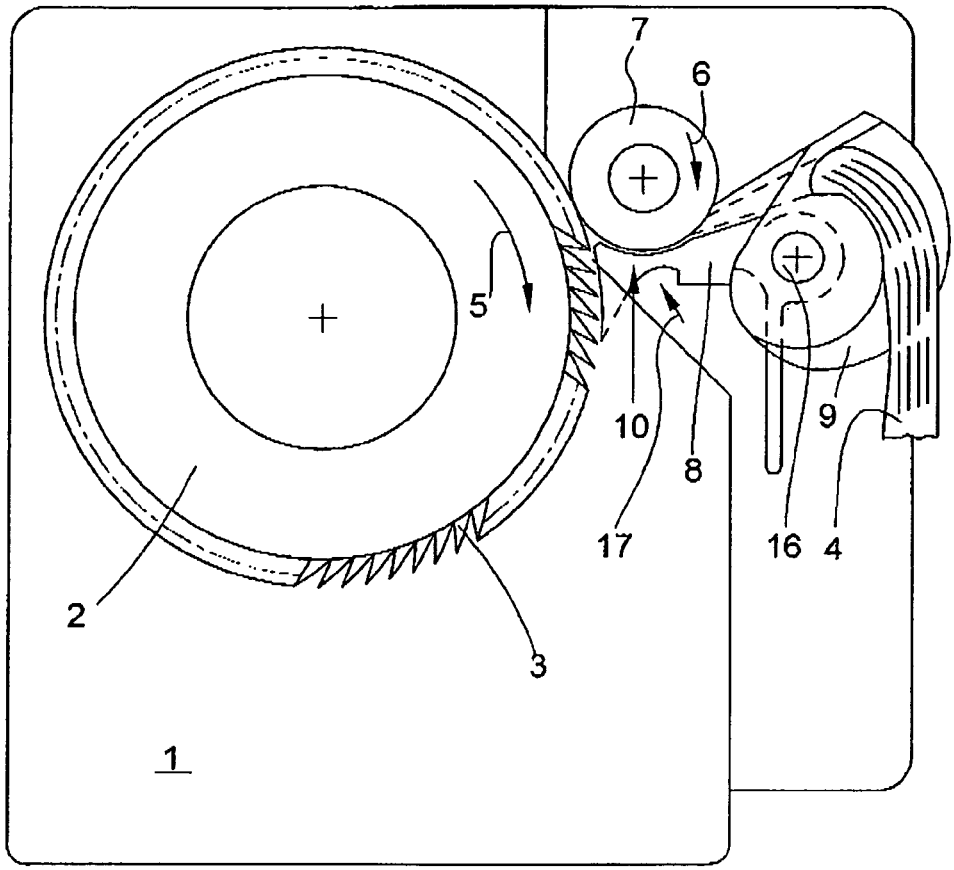
FIG. 1, a front view of a fiber opening device of an open-end spinning machine, in which the feeding trough in accordance with the invention is represented in a lateral view, FIG. 2, a feeding trough in accordance with the invention, in a lateral view, on a larger scale and partially in section, FIG. 3, the feeding trough in accordance with FIG. 2 in a front view, FIG. 4, a feeding trough, such as is known from the prior art, in a front view.

An opening roller housing 1 of an open-end spinning device is represented in FIG. 1.

An opening roller 2 is rotatably seated in this opening roller housing 1, which has on its exterior circumference a so-called opening roller set 3 for combing-out a feed sliver 4. During the spinning operation, the opening roller 2 rotates in the direction of the arrow 5. A sliver draw-in cylinder 7, as well as an associated feeding trough 8, are furthermore seated in or on the opening roller housing 1.

As indicated in FIG. 1, the feed sliver 4, which customarily is stored in a not represented spinning can, is conducted via a sliver condenser 9 into a gripping zone 10, which is constituted by the feeding trough 8 and the fiber draw-in cylinder 7.

In the process, the feeding trough 8 is prestressed by means of a spring element (not represented) in the direction toward the sliver draw-in cylinder 7 and presses the feed sliver 4 against the sliver draw-in cylinder 7 rotating in the direction of the arrow 6, which can be discontinuously driven.

The sliver draw-in cylinder 7 conveys the feed sliver 4 into the area of the opening roller 2, whose opening roller set 3 combs out the feed sliver 4 into individual fibers, which in a known manner are subsequently fed to a spinning rotor via a fiber guide conduit.

Figure 2:
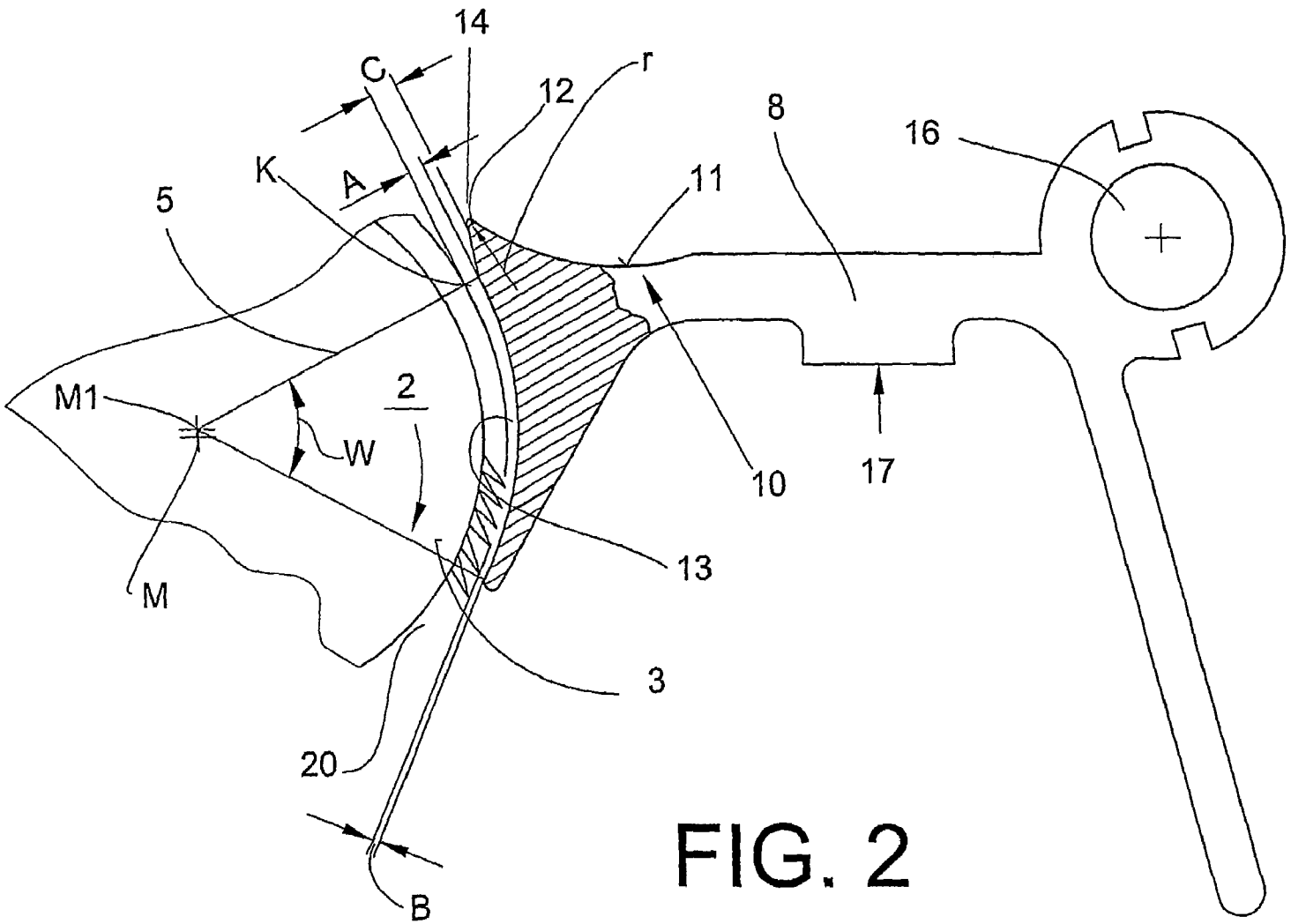
Figure 3:
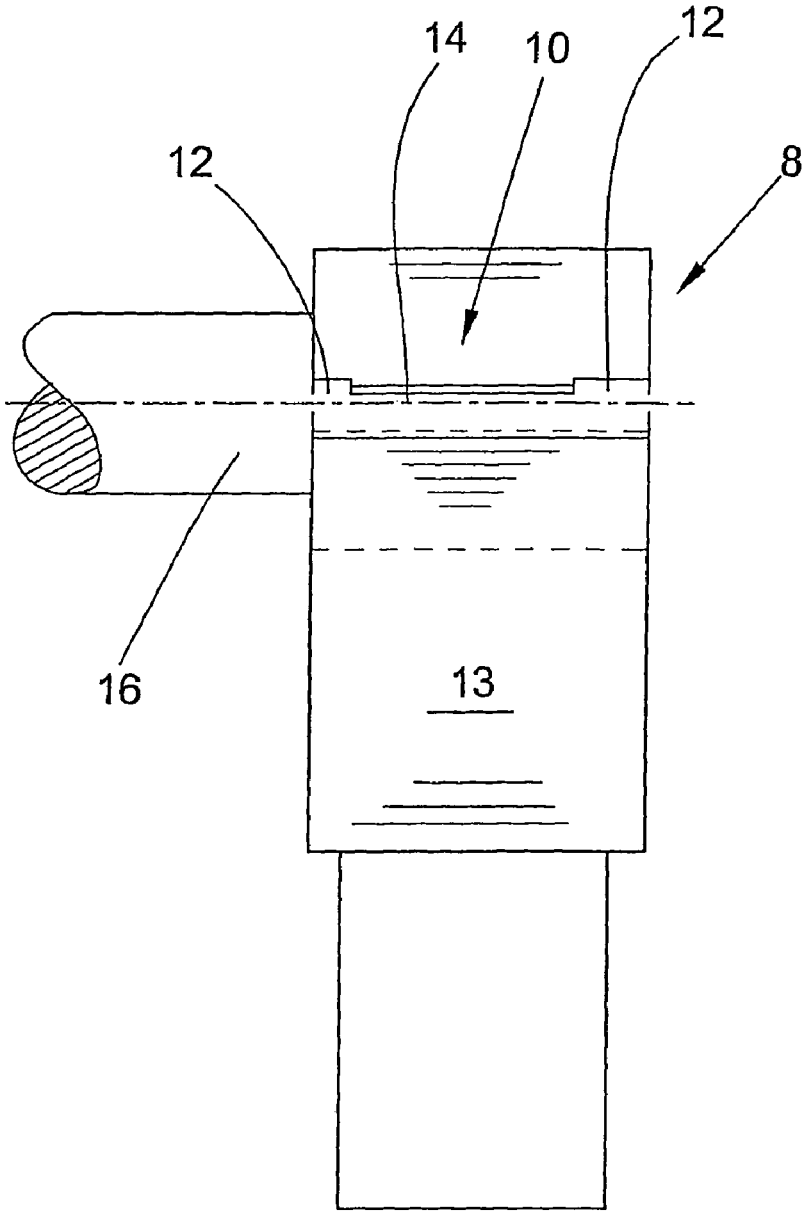

In order to assure a correct guidance of the feed sliver 4, even when producing novelty yams, in particular during the acceleration phase of the sliver draw-in cylinder 7, the feeding trough 8 has the embodiment and arrangement represented in greater detail in FIGS. 2 and 3.

As indicated in FIG. 2, the feeding trough 8 in accordance with the invention is seated, movable in a limited manner around a pivot shaft 16, and in the course of this is prestressed by a spring element (not represented) in the direction of the arrow 17 opposite to this movement direction.

The feeding trough 8 has a concavely curved gripping area 11, as well as an also concavely curved support surface 13 for the fiber tuft.

A convexly rounded transition area 14, whose radius r lies at less than 2 mm, is arranged between the sliding and gripping area 11 and the support surface 13.

Furthermore, lateral guide shoulders 12 are provided at the level of the transition area 14, which prevent the excursion of the feed sliver 4 during the comb-out of the feed sliver 4.

To assure that the feed sliver 4 cannot escape, even in the acceleration phase of the sliver draw-in cylinder 7, and is immediately completely combed out, the feed sliver 4 is conducted by the gripping area 11 of the feeding trough 8 as closely as possible to the area of the tips 20 of the opening roller set 3, and is fixed by a support surface 13.

This means that only the convexly rounded transition area 14 of a very small radius r=1.5 mm is arranged between the gripping area 11 and the support surface 13.

The extremely small radius r of the transition area 14 results in the distance C between the transition area 14 and the tips 20 of the opening roller set 3 to be only 3 mm here, i.e. the free nip between the gripping area 11, the support surface 13 and the tips 20 of the opening roller set 3 is minimized.

As can be further seen from FIG. 2, the support surface 13 of the feeding trough 8 has been conducted increasingly closer to the tips 20 of the opening roller set 3, starting at a combing-in point K.

The gap width A at the combing-in point K is 1 mm. The gap width B resulting at the end of the gap following an angle area W of 40° in the direction of rotation of the opening roller is 0.3 mm here. For achieving the reduction of the gap width from A to B, the radius constituted by the tips 20 of the opening roller set 3 corresponds to the radius of the curvature of the support surface 13 from the combining-in point K over the angle W and the center M1 for the curvature of the support surface 13 is correspondingly offset in respect to the center M of rotation of the opening roller.

FIG. 3 shows a front view of the feeding trough 8 in accordance with the invention.

As can be seen, the convexly rounded transition area 14 bordered by the lateral guide shoulders 12 makes an almost immediate transition into the concavely rounded support surface 13.

This means that the feed sliver 4, once it has traversed the transition area 14, is immediately increasingly conveyed against the opening cylinder set 3, so that it is combed out by the opening cylinder set 3 into individual fibers without delay, even in case of an increased amount of fibers occurring at the start of the effect.

Figure 4:
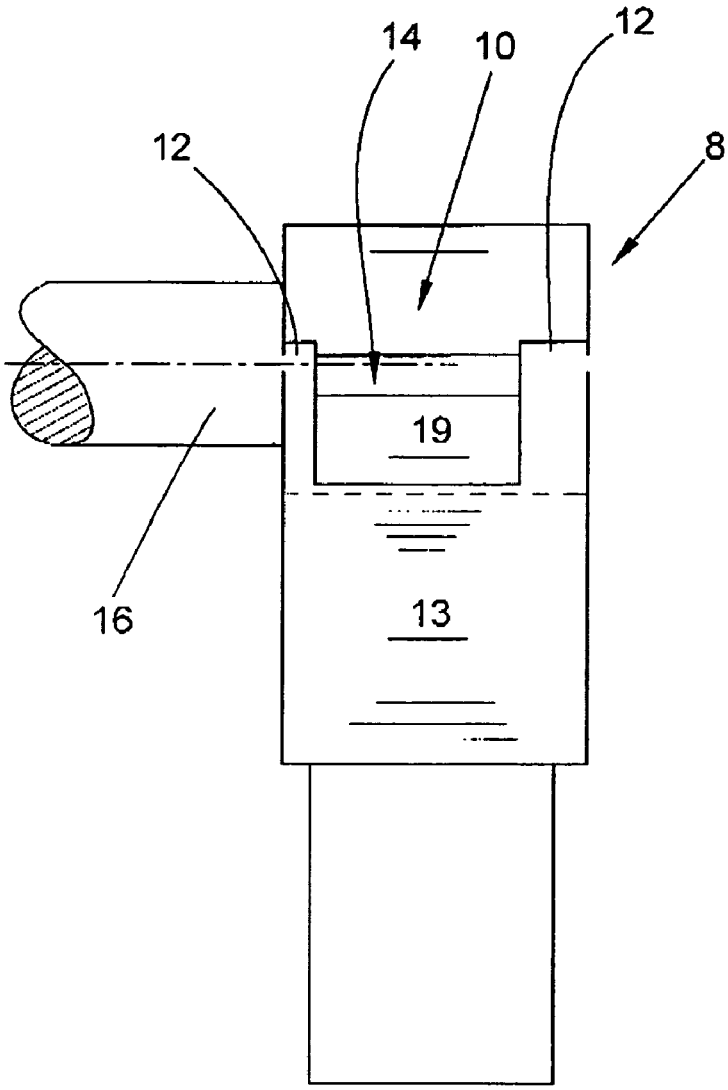
Prior Art FIG. 4

FIG. 4 shows a feeding trough in accordance with the prior art. As represented, with such feeding troughs a level guide surface 19, which has been cut into the support surface 14, adjoins a transition area 14, which is bordered by lateral guide walls.

With such an embodiment a free nip results between the level guide surface 19 and the opening roller set 3, which has negative effects in connection with the production of novelty yarn, because during the acceleration phase of the fiber draw-in cylinder 8 the feed sliver backs up there and is then not correctly opened.

The invention claimed is:

1. A fiber opening device for an open-end spinning device comprising in combination:

a cylindrical opening roller (2) having a circumferential fiber opening surface covered with projecting teeth (20) and operative to rotate about an axis (M) in a defined direction of rotation for separating a feed sliver (4) into individualized fibers for spinning into a yarn, a draw-in cylinder (7) rotatable adjacent the opening roller (2) about a parallel axis for delivering the feed sliver to the opening roller (2), and a feeding trough (8) operative in conjunction with the sliver draw-in cylinder (7) and the opening roller (2) for conveying the feed sliver (4), the feeding trough (8) comprising:

a concavely shaped sliver gripping area (11) facing the sliver draw-in cylinder (7) for guiding the feed sliver therealong to the opening roller (2), a concavely shaped fiber support surface (13) facing the opening roller (2) for guiding therealong individualized fibers opened by the opening roller (2) toward a spinning location, and a transition area (14) between the support surface (13) and the gripping area (11), the feeding trough (8) being pivotable about a pivot axis (16) parallel to the axis (M) of rotation of the opening roller (2) for pivoting movement toward the draw-in cylinder (7) and the opening roller (2) into an operating position of the feeding trough (8) and for pivoting movement away from the draw-in cylinder (7) and the opening roller (2) in an angular direction of pivot rotation opposite the direction of rotation of the opening roller (2) into a non-operating position, the feeding trough (8) defining in its operating position a gap between the support surface (13) and the teeth (20) of the opening roller (2) and the feeding trough (8), the feeding trough (8) being configured and arranged such that, when in the operating position:

the gap is maintained at a dimension A between 0.7 mm and 1.5 mm at a sliver combing-in point K along the circumference of the opening roller (2) and the gap constantly reduces to a dimension B less than or equal to 0.5 mm over a circumferential section W of the opening roller (2) extending from the combing-in point K in the direction of rotation of the opening roller (2) for at least 30° of the opening roller circumference, and the gap increases in the direction opposite to the rotation of the opening roller (2) away from the combing-in point K to a dimension C at the transition area (14) between the support surface (13) and the gripping area (11), the dimension C being sufficient substantially only that contact with the tips of the opening roller teeth (20) does not occur when pivoting the feeding trough (8) into its non-operating position.

2. The feeding trough in accordance with claim 1, characterized in that in the transition area (14) the feeding trough (8) has a convex curvature of a radius $r \leqq 2.0$ mm.

3. The feeding trough in accordance with claim 2, characterized in that lateral guide shoulders (12) for the feed sliver (4) are arranged in the convexly rounded transition area (14).

4. The feeding trough in accordance with claim 3, characterized in that the lateral guide shoulders (12) exclusively extend over the transition area (14).

5. The feeding trough in accordance with claim 1, characterized in that the gap width in the transition area (14) assumes the distance $C \leqq 4$ mm.

6. The feeding trough in accordance with claim 1, characterized in that the radius constituted by the teeth (20) of the opening roller (20) corresponds to the radius of curvature of the support surface (13) from the combing-in point K over the circumferential section W, and that, for achieving the change of the gap width from A to B, the center M1 for the curvature of the support surface (13) is correspondingly offset in respect to the center M of rotation of the opening roller (2).

7. The feeding trough in accordance with claim 1, characterized in that the feeding trough (8) is embodied in one piece and is provided with a wear-protective layer in its fiber-conducting areas (11, 13, 14).

* * * * *